343-700 MS AU 251 EX
3/24/87 XR 4,652,889

United States Patent [19]

Bizouard et al.

[11] Patent Number: 4,652,889

[45] Date of Patent: Mar. 24, 1987

[54] PLANE PERIODIC ANTENNA

[75] Inventors: Alain Bizouard, Chaville; Gérard Dubost, Rennes, both of France

[73] Assignee: Thomson-CSF, Paris, France

[21] Appl. No.: 679,646

[22] Filed: Dec. 10, 1984

[30] Foreign Application Priority Data

Dec. 13, 1983 [FR] France ..... 83 19924

[51] Int. Cl.[4] ..... H01Q 11/10; H01Q 21/08

[52] U.S. Cl. ..... 343/792.5; 343/700 MS; 343/846

[58] Field of Search ..... 343/792.5, 700 MS, 770, 343/829, 846, 708, 731, 739, 905

[56] References Cited

U.S. PATENT DOCUMENTS

| | | | |
|---|---|---|---|
| 3,110,030 | 11/1963 | Cole | 343/792.5 |
| 3,509,573 | 4/1970 | Balmain | 343/792.5 |
| 3,633,207 | 1/1972 | Ingerson | 343/770 |

FOREIGN PATENT DOCUMENTS

| | | | |
|---|---|---|---|
| 798821 | 7/1958 | United Kingdom | 343/700 MS |
| 2064877 | 6/1981 | United Kingdom | 343/700 MS |

*Primary Examiner*—Eli Lieberman
*Assistant Examiner*—Michael C. Wimer
*Attorney, Agent, or Firm*—Oblon, Fisher, Spivak, McClelland & Maier

[57] ABSTRACT

The invention relates to a plane periodic antenna, wherein it comprises a conductive plate having radiating elements formed from two lines of flat teeth, whereof the dimensions are deduced from one another on the basis of a homothetic transformation of ratio $\tau$ and expansion pole O, the teeth of one of the two lines being inserted between the teeth of the other line and the end of one given tooth being separated from the edge of the plate located between two teeth of the other line by a predetermined gap, a supply line place in a plane close to that of the plate making it possible to supply the teeth, from the predetermined gap, a ground plane located at a distance from each tooth varies as a function of the wavelength of each tooth.

12 Claims, 4 Drawing Figures

PLANE PERIODIC ANTENNA

BACKGROUND OF THE INVENTION

Field of the Invention

The present invention relates to plane periodic antennas of the log-periodic type.

Discussion of Background

In general, periodic antennas are very broad band antennas, which are independent of the frequency of the supply signal. They are constituted by radiating elements, whose dimensions are deduced from one another by a homothetic transformation of ratio $\tau$ on the basis of a given expansion pole. Two consecutive radiating elements have the same properties, one at a frequency f being its resonant frequency, and the other at the frequency $f/\tau$ or $f\tau$. The factor $\tau$ is generally close to unity, so that this type of antenna has only slightly differing characteristics over a wide frequency band.

Plane periodic antennas are formed from flat radiating elements, as opposed to filler radiating elements and in general terms volumetric elements. Thus, a plane antenna is understood to mean an antenna whose radiating elements have a limited thickness, said thickness being insignificant compared with the lengths and widths of the elements.

Conventionally, a plane periodic antenna is constituted by two plates in the same plane, each being formed by two series of teeth, these teeth being trapezoidal. Therefore, the antenna is constituted by two half-antennas, which are symmetrically supplied from their top. The radiation pattern is symmetrical with respect to the plane of the antenna with the maxima following the normal to said plane. Thus, the antenna has directivity normal to the plane of its structure.

In certain applications, when it is wished to place the periodic antenna on a flat or curved metal structure without disturbing the aerodynamics of said structure, it is necessary to use plane periodic antennas. However, the operation of the antenna is disturbed, because it is engaged with the metal structure, which behaves like a reflector which is not adapted to the operation of the antenna.

Moreover, it is sometimes necessary to obtain a radiation pattern, whose main beam slopes relative to the antenna structure. However, a conventional plane periodic antenna does not make it possible to have a slope of the main lobe relative to the plane of its structure.

SUMMARY OF THE INVENTION

It is for the purpose of obviating these two disadvantages that the present invention proposes a broad band plane periodic antenna making it possible to operate in undisturbed manner, when it is engaged on a flat or curved metal structure and to have a main lobe sloping with respect to the normal of the metal structure.

Thus, the present invention proposes a plane periodic antenna, wherein it comprises radiating elements formed from two lines or plates of flat teeth, whose dimensions are deduced from one another on the basis of a homothetic transformation of ratio $\tau$ and expansion pole O, the teeth of one of the lines being inserted between the teeth of the other line and the end of a given tooth being separated from the edge of the plate located between two teeth of the other line by a predetermined gap $\epsilon$, a supply line placed in a plane close to the plane of the plate makes it possible to supply the teeth from the predetermined gap, a ground plane located at a distance $H_n$ from each teeth, varying as a function of the resonant wavelength $\lambda_n$ of each tooth, whereby the antenna can be fixed in a flat or curved metal structure without changing the aerodynamics of said structure.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

In order to facilitate understanding, the plane of the radiating structure B is defined as the plane of the sheet and the axis OD, an axis which passes through the expansion pole O and which is the longitudinal axis of the antenna.

Figures 1, 2, 3:
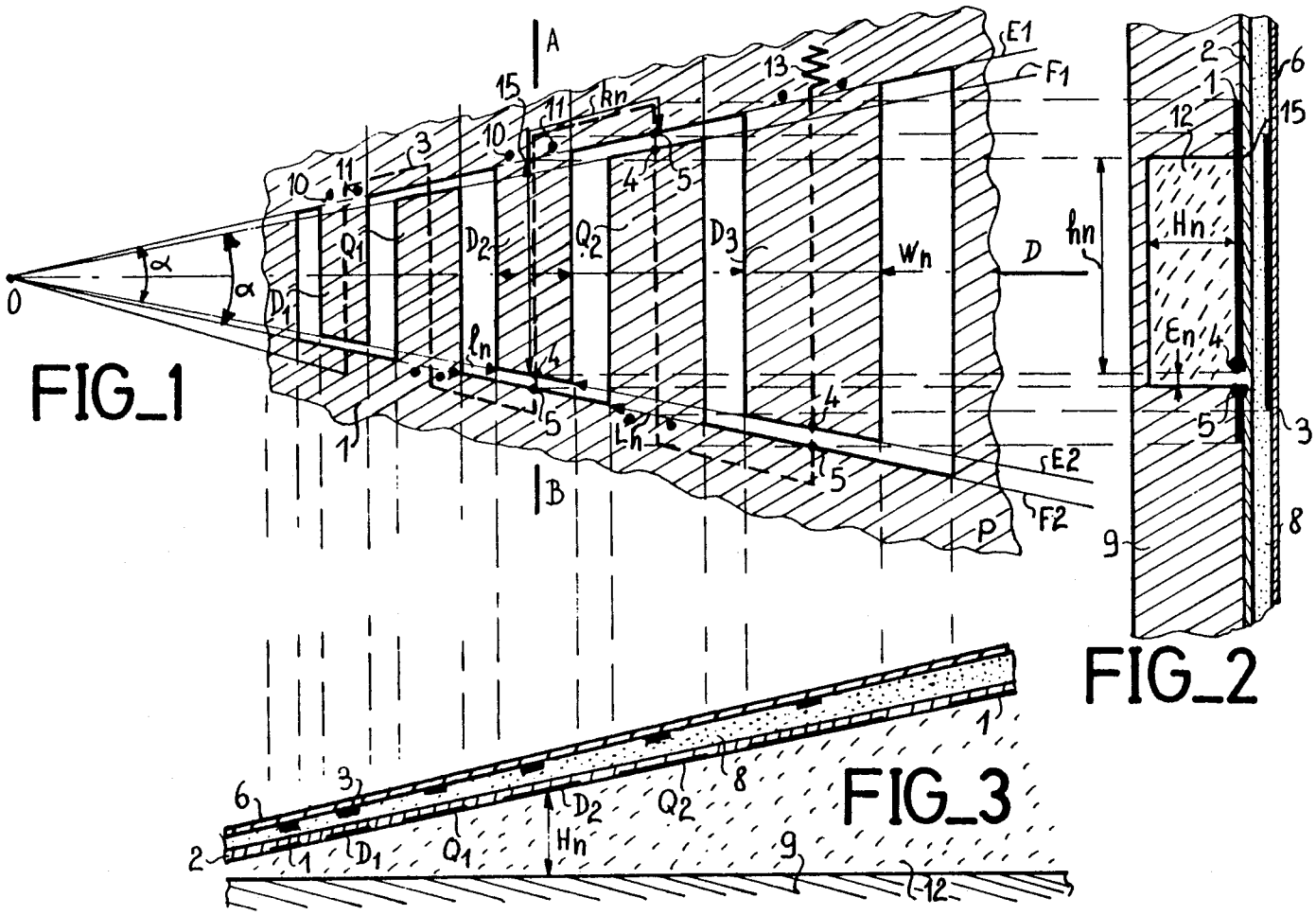
FIG. 1 in section the antenna according to the invention along the plane of its radiating structure.
FIG. 2 a section along an axis AB of FIG. 1.
FIG. 3 a section along an axis OD of FIG. 1.

Thus, FIG. 2 is a section along a plane containing the axis AB perpendicular to the axis OD and FIG. 3 represents a section along a plane perpendicular to plane P and containing axis OD.

FIGS. 1, 2 and 3 are sections along three different planes of the plane periodic antenna according to the invention and are described in undifferentiated manner hereinafter. The antenna shown therein is a periodic antenna of expansion pole O. A conductive plate 1 is constituted by a line of teeth $D_1$ to $D_m$ and a line of teeth $Q_1$ to $Q_p$, $p=m$ or $p=m-1$, being inserted between the teeth of the first line.

The number of teeth varies as a function of the desired radiation characteristics for the antenna. Only three teeth are shown in the first line and two in the second line ($m=3$ and $p=2$). According to a preferred embodiment, the teeth have a trapezoidal shape. However, it is obvious that the invention also applies to antennas, whose teeth have any shape presently used in log-periodic antennas of the rectangular type or with an expansion pole centre circular arc axis.

The dimensions of teeth $D_1$, $D_2$, $D_3$ can be deduced from one another by a homothetic transformation $\tau^2$ and of pole O. In the same way, the dimensions $Q_1$ and $Q_2$ can be deduced from one another by a homothetic transformation $\tau^2$ and pole O, the dimensions of $Q_1$ relative to $D_1$ being obtained by multiplying by $\sqrt{\tau}$.

In per se known manner, the dimensions of the nearest tooth to the pole define a first resonant frequency $f_M$ giving the order of magnitude of the upper limit of the antenna pass band, in the same way as the dimensions of the tooth furthest from the pole define a resonant frequency $f_m$ giving the order of magnitude of the lower limit of the antenna pass band.

Teeth $D_1$, $D_2$ and $D_3$ are inscribed in an envelope defined by lines $E_1$ and $E_2$ secant to the pole O and forming an angle $\alpha$. Teeth $Q_1$ and $Q_2$ are inscribed in an envelope defined by lines $F_1$ and $F_2$ also secant to pole O and forming the same angle $\alpha$.

Plate 1 is formed on the single metallized face of a printed circuit 2 of limited thickness compared with the working wavelength and which is shown in sectional form in FIG. 2. The wavelength $\lambda$ of the transmitted wave varies between the extreme wavelengths $\lambda_m$ and $\lambda_M$ defined by the pass band.

A supply line 3 shown in broken line form in FIG. 1 makes it possible to supply the antenna by exciting the radiating elements from points 4 and 5, which will be defined hereinafter. This supply line 3 is realised by a metallized strip printed on a printed circuit 6, which is also of limited thickness. The metallized face of circuit 6 is on the side of the unmetallized face of circuit 2, so that circuit 6 acts as a protector in the same way as a radome with respect to the outside. Circuit 6 is located in a plane close to the plane of circuit 2 and, for example, containing the expansion pole O, or in a plane parallel to the plane of circuit 2 and in the nearness thereof. The two circuits 2 and 6 are separated by a dielectric 8 which, in the limiting case, can be constituted by air or a honeycomb.

Line 3 describes trapezoidal teeth which are deduced by a homothetic transformation of ratio $\tau$ and pole O, whose sides are parallel to the sides of the radiating teeth and pass through the centers 4 of end segments $L_n$ of each tooth and through the centers of the opposite segments $L_n$. The break (or cut-off) of width $\epsilon_n$ between these two points 4 and 5 makes it possible to excite the radiating elements.

Circuit 2 is integral with the metal structure 9, (its ground plane) on which is engaged the antenna and plate 1 is maintained in electrical contact with structure 9 level with line portions $OE_1$ and $OF_2$ passing through the respective points 5 and 15. For example, this contact is ensured by means of the screws 10, 11 shown in FIG. 1.

The section shown in FIG. 3 makes it possible to reveal the height $H_n$ separating the earth plane from each radiating element.

Obviously, the parameters designated by n vary as a function of n, in which n is the index designating the tooth, the total number of teeth being designated N (N=5 in the case of FIG. 1). Thus, for the first tooth, there will be a length $h_1$, a gap $\epsilon_1$ and a height $H_1$.

The radiating elements behave like half-dipoles short-circuited at quarter-wave resonance. Thus, for this purpose, it is necessary to have the relation $H_n+h_n=\lambda_n/4$. Thus, each radiating element is short-circuited at one of its ends 15 to the metal structure 9, on which is engaged the antenna. The other end 4 is insulated from the metal structure and the resulting break is excited by the supply line. The radiating impedance of the plate short-circuited at quarter-wave resonance is inserted in series in the microstrip 3 at the point of the break.

The dimensions of the radiating elements are chosen in such a way that, when the strip line supply line 3 transmits a wave whose frequency is below the natural resonant frequency of a given tooth, the latter, at its break, has a low impedance which only slightly disturbs the transmission of the line.

The slope angle of the radiation pattern on the plane of the structure is directly linked with the geometrical or electrical length $k_n$ of the microstrip 3 between the breaks of the two adjacent radiating sources. Consideration is given to the electrical length when the line is in the presence of a dielectrical material. Thus, it is easy to modify the slope angle by modifying said length. The relation existing between the slope angle between the main beam and the plane of the antenna structure and the line of length $k_n$ supplying two half-dipoles short-circuited at the quarter-wave resonance results from known theoretical calculations appearing in the articles by G. Dubost in IEEE Transactions entitled "Antennas and Propagation" of May 1981 and 1983.

However, one condition must be respected to ensure that there is no variation in operation. Thus, the electrical length $K_n$ must be less than $\lambda_n/2$ to ensure no mismatching of the antenna. Thus, partial reflections due to the insertions of radiating elements along the line are not accumulated.

The most favourable case occurs when length $k_n$ is equal to $\lambda_n/4$, because it permits a substantially ideal compensation of all the reflections. However, for practical reasons, an intermediate length of eg. 0.3 $\lambda_n$ is imposed, which corresponds to a well matched input impedance, bearing in mind the other geometrical and electrical parameters. In order to ensure the best matched length, it is consequently necessary for the radiating elements to be intercalated.

For modifying the electrical length of line 3, it is obviously possible to modify the dielectric 8 (its dielectric constant or thickness) and also give the line a different shape, e.g. if it is wished to reduce its geometrical length it will not be made to strictly follow the median axis of each plate in the manner shown in FIG. 1, but still passes through the centre of the various breaks.

Action can also be taken on the length of the radiating plates by placing a dielectric material 12 in the space between the metal structure 9 and the metal plate 1 having the teeth. By in this way reducing the length $h_n$ of each radiating element, this makes it possible to reduce the length of the line 3 between two breaks. Line 3 is closed on its characteristic impedance by means of a resistor 13 fitted at its end furthest from pole O. This resistor can be an element with localized constants or a dipole with distributed constants.

Some theoretical results are given hereinafter for a choice of different parameters and the pass band. By choosing:

$f_m=0.9$ GHz
$f_M=9$ GHz
$\tau=0.95$
$W_n/\lambda_n=0.166$
$H_n/\lambda_n=0.1$
$k_n/\lambda_n=0.35$ $R_a$ characteristic impedance of line 3 equal to 150Ω and N=50, the following results are obtained. The theoretical slope angle of the beam, i.e. the angle between the radiation maximum direction and the direction perpendicular to the plane of the structure is 50°. The 3 dB aperture of the main beam, which is essentially of revolution is equal to 45°. The standing wave ratio of the input impedance of the antenna related to the characteristic resistance of the line is below 2 in the complete band 0.9 to 9 GHz.

Figure 4:
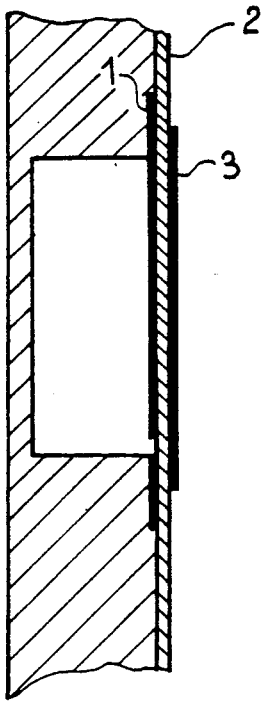
FIG. 4 a constructional variant of the antenna viewed in section along axis AB.

FIG. 4 shows a constructional variant, the antenna being viewed in section as in FIG. 2.

In this variant, supply line 3 is located on the opposite face of circuit 2, said circuit having the radiating elements on the other face. In this case, it is a dielectric substrate metallized on both faces. This variant is advantageous from the dimensional standpoint.

The construction which has been described relative to a plane antenna, i.e. an antenna whose radiating elements have a very small thickness compared with their length and their width. Moreover, this antenna has an overall planar structure, i.e. it can be fitted onto a planar metal structure. However, it is obvious that the invention relates also to antennas having a generally curved structure for fitting to curved metal structures (such as in aircraft). All that is necessary for this purpose is to adapt the shape of the circuits on which the antenna elements are placed to the shape of the metal structure, whilst respecting the operating conditions given hereinbefore.

In conclusion, the antenna according to the invention obviously has the advantages of a conventional log-periodic antenna, because it has a very broad pass band. Moreover, it can easily be fitted into a metal structure and does not modify the aerodynamics, because it is a planar surface and its groundplane adapted to the construction can be fitted into the metal structure.

It also has the advantage of being able to radiate in a direction inclined with respect to the normal to the plane of its structure, which is useful when the antenna is e.g. placed on an aircraft.

What is claimed is:

1. A plane periodic antenna, comprising:

a conductive plate having radiating elements formed from two plates, each of said plates comprising a series of flat teeth, whereof the dimensions are deduced from one another on the basis of a homothetic transformation of ratio $T^2$ and expansion pole O, the teeth of one of the two series being inserted between the teeth of the other series and the end of one given tooth being separated from the edge of the plate located between two teeth of the other series by predetermined gap $\epsilon$;

a supply line placed in a plane close to that of the plate making it possible to supply the teeth from the predetermined gap $\epsilon$;

a ground plane located at a distance $H_n$ from each tooth which distance varies as a function of the variant wave-length $\lambda_n$ of each tooth, so that the antenna can be fitted into a flat structure without changing the aerodynamics thereof and in which the length $k_n$ of the feed line between two gaps $\epsilon$ is less than $\lambda_n/2$ and greater than or equal to $\lambda_n/4$ to obtain a radiation of the antenna in a sloping direction with respect to the plane of the structure.

2. A periodic antenna according to claim 1, wherein the teeth are parallel.

3. An antenna according to claim 1, wherein the teeth have a trapezoidal shape.

4. An antenna according to claim 1, wherein $h_n$ being the length of one tooth, the sum of the lengths $H_n$ and $h_n$ must be substantially equal to $\lambda_n/4$, each tooth and the ground plane thus constituting a half-dipole short-circuited to quarter-wave resonance.

5. An antenna according to claim 1, comprising a first printed circuit of limited thickness compared with the wavelengths of the transmission frequencies and wherein the two series of teeth are produced on a metallized face of said first printed circuit.

6. An antenna according to claim 5, wherein the ground plane located at height $H_n$ of each tooth is integral with the first printed circuit and is electrically connected to the metallized face of said circuit.

7. An antenna according to claim 6, wherein the ground plane is electrically connected to the metallized face by means of screws placed on the plate.

8. An antenna according to claim 1, wherein the space, defined by distance $H_n$, between the ground plane and the plate is filled with a dielectric material.

9. An antenna according to claim 5, comprising a second printed circuit of limited thickness compared with the wavelengths of the transmission frequencies and wherein the supply line is a microstrip formed on a metallized face of said second printed circuit.

10. An antenna according to claim 9, wherein the metallized face of the second printed circuit is located in a plane containing the expansion pole and close to the plane in which is located the first printed circuit, so that the supply line is located in the center of the gap $\epsilon$.

11. An antenna according to claim 10, wherein a dielectric material is placed between the first and second printed circuits.

12. An antenna according to claim 5, wherein the supply line is a microstrip formed on another metallized face of the first printed circuit.

* * * * *